US012221193B2

(12) United States Patent
Le et al.

(10) Patent No.: US 12,221,193 B2
(45) Date of Patent: Feb. 11, 2025

(54) MARINE TRANSFER APPARATUS AND METHOD OF USING THE SAME

(71) Applicant: ØRSTED WIND POWER A/S, Fredericia (DK)

(72) Inventors: Nina F Le, Fredericia (DK); Emil Engelbrecht, Fredericia (DK)

(73) Assignee: Ørsted Wind Power A/S, Fredericia (DK)

( * ) Notice: Subject to any disclaimer, the term of this patent is extended or adjusted under 35 U.S.C. 154(b) by 0 days.

(21) Appl. No.: 18/238,060

(22) Filed: Aug. 25, 2023

(65) Prior Publication Data

US 2024/0067309 A1 Feb. 29, 2024

(30) Foreign Application Priority Data

Aug. 25, 2022 (EP) ..... 22192201

(51) Int. Cl.
*B63B 27/16* (2006.01)
*B63B 27/30* (2006.01)

(52) U.S. Cl.
CPC ..... *B63B 27/16* (2013.01); *B63B 27/30* (2013.01)

(58) Field of Classification Search
CPC .... A62B 1/00; A62B 1/06; B66D 1/04; B66D 1/7489; B66D 3/00; B63B 27/18; B63B 27/16; B63B 27/30; B63B 27/32; B66C 21/00; B66C 2700/011; B66C 13/02; G02B 6/475; H02G 1/081
See application file for complete search history.

(56) References Cited

U.S. PATENT DOCUMENTS 2,553,779 A * 5/1951 McLain ..... H02G 1/04 254/134.3 PA
2,838,279 A * 6/1958 Parkyn ..... H02G 1/04 248/214
2,902,257 A * 9/1959 Young ..... H02G 1/04 254/390
3,707,922 A * 1/1973 Dillon ..... B63B 27/18 254/338

(Continued)

FOREIGN PATENT DOCUMENTS

EP 3653484 A1 5/2020
EP 3766774 A1 * 1/2021 ..... B63B 27/18
WO 2011095316 A1 8/2011

OTHER PUBLICATIONS

Extended European Search Report; European Patent Application No. 22192201.6; Ørsted Wind Power A/S; dated May 23, 2023.

*Primary Examiner* — Gregory W Adams
(74) *Attorney, Agent, or Firm* — SandBright, PLLC; Robert Dan Spendlove

(57) ABSTRACT

Marine transfer apparatus for transferring a load (12) between a vessel (20) and an offshore structure (1). A coupling part (4) is mounted to an elevated mounting point. A climbing part (8) comprising a climbing line (8*a*) and a locking member (10) fixed to one end of the climbing line (8*a*) is provided. The climbing line (8*a*) is feedable through the coupling part (4) until the locking member (10) locks against the coupling part (4) for forming a loadbearing connection. A drag line (5) is feedably connected to the coupling part (4) and includes a fastener (7) for attaching the climbing line (8*a*) for dragging it through the coupling part (4).

15 Claims, 5 Drawing Sheets

(56) References Cited

U.S. PATENT DOCUMENTS

| | | | | |
|---|---|---|---|---|
| 6,145,679 | A * | 11/2000 | Walters | B66C 21/00 212/87 |
| 8,789,815 | B2 * | 7/2014 | Deel | H02G 1/06 254/389 |
| 2021/0396214 | A1 * | 12/2021 | Andersen | B63B 27/30 |
| 2022/0002121 | A1 * | 1/2022 | D'Eufemia | B63B 27/18 |

* cited by examiner

MARINE TRANSFER APPARATUS AND METHOD OF USING THE SAME

The present application claims priority to European Patent Application EP 22192201.6 filed on 25 Aug. 2022, which is incorporated herein by reference.

The present invention concerns a marine transfer apparatus and method for transferring a body between a vessel and an offshore structure and, in particular, a marine transfer apparatus and method for use with a monopile offshore structure, such as a wind turbine generator having a monopile foundation, as well as floating offshore structures. The disclosure is also relevant to an offshore structure incorporating an apparatus for facilitating transfer from and to a vessel.

Transferring a body, such as a person or an object, between a marine vessel, such as a boat, and a fixed offshore structure can be a challenging and hazardous process. Waves in the water, caused by wind or swell, act on the vessel, moving its position relative to the offshore structure. In particular, as waves pass through, the vessel is subjected to movements, such as heave, sway and surge. In some circumstances it may be possible to minimise motions such as roll, yaw, sway and surge by driving the vessel into docking engagement against the offshore structure. However, vertical motions are difficult to mitigate, and are especially hazardous because there is a risk that the person could get caught between the vessel and the structure when they are attempting to transition from the vessel onto, for example, a static ladder provided on the exterior of an offshore structure.

A common method to address the above is to provide a powered hoist on an offshore platform. To access the platform, a user can remotely control the hoist to lower a cable, to which they then connect for being hoisted up to the platform. The mechanised winch allows the user to be rapidly lifted away from the vessel, and such systems often additionally include distance control feedback of the winch to compensate for vessel movements by tracking its motion using lasers. This provides for improved safety and is less tiring to the user as they aren't required to climb a ladder. However, such power winching or hoisting mechanisms are relatively complex and consequently can be prone to periodic breakdown, particularly given the relatively harsh environmental conditions they are exposed to. If a powered hoist isn't working for whatever reason, it can then become very difficult to access the offshore platform. For example, the hoisting cable may not be able to be lowered. A specialist climbing crew may then be required, for instance, to use temporary ropes to climb up to the platform and repair the powered hoist to allow other personnel to access. This can take time to schedule, and therefore presents a significant problem if urgent access to the wind turbine generator is needed.

Accordingly, there is a need for a simplified marine transfer apparatus and method that may, for instance, be used as a backup in the event that a powered hoist system for accessing an offshore wind turbine is non-operational.

According to a first aspect of the present invention, there is provided a marine transfer apparatus for transferring a load between a vessel and an offshore structure, the apparatus comprising: a coupling part for mounting to an elevated mounting point on the offshore structure; a climbing part comprising a climbing line and a locking member fixed to one end of the climbing line, the climbing line being feedable through the coupling part until the locking member locks against the coupling part for forming a loadbearing connection thereto; and a drag line feedably connected to the coupling part, and comprising a fastener for attaching the climbing line for dragging it through the coupling part as the drag line is fed therethrough.

Accordingly, with the above marine transfer apparatus, a user, such as a wind turbine engineer, can use the drag line accessible from a lower position to feed a locking member through a coupling part mounted in an elevated position, such as on or above a platform on the offshore structure. The coupling allows a locking engagement to form with the locking member once the climbing line is fed through until the locking member is reached. This thereby leaves the free end of the climbing line to be used to ascend, for example using an ascender/descender device. Importantly, the apparatus may be operated manually, with only the drag line and the mounting point needing to remain on-site. As such, the risk of mechanical breakdown is avoided and, since the drag line does not have a load bearing function during ascent, its extended exposure to environmental conditions does not present a safety hazard. Accordingly, the climbing line can be mounted to provide safe access to an offshore structure from a vessel, without needing to rely on a powered hoist or ladder.

In embodiments, the coupling part comprises a support defining an aperture through which the drag line is secured, and wherein the locking member is configured to lock against the coupling part by engaging with the support to form the loadbearing connection thereto. In this way, the coupling part may be provided as a simple support enclosure around the climbing line, and against which the locking member may engage against as the climbing line is drawn through.

In embodiments, the support defines a ring, and wherein the locking member comprises a disc-shaped plug configured to lock against the ring. In this way, the coupling part may be provided by a simple ring construction with the locking member being configured as a plug for engaging against the periphery of the ring.

In embodiments, the coupling part forms an upper pulley. In this way, the coupling part may be used to direct the drag line to change direction to allow the climbing line to be smoothly lifted up to the elevated position and carried back down to allow a user to ascend using the line.

In embodiments, the drag line comprises a loop connected through the coupling part. In this way, the drag line may be provided as a continuous loop of rope or cable which can be cycled through the coupling part in both directions by pulling on a section of the loop.

In embodiments, the marine transfer apparatus further includes a lower pulley for connecting the drag line to a lower mounting point on the offshore structure. In this way, the drag line may be conveniently located on the offshore structure for access by a user at a vessel.

In embodiments, the marine transfer apparatus further includes a tensioner mechanism for tensioning the drag line into a retracted position, and wherein the tensioner mechanism can be operated for allowing the drag line to be drawn out to an extended position. In this way, the tensioner mechanism may be used to keep the drag line in position above the waterline, and a user may gain access to the drag line by drawing it out against the resilience of the tensioner. For example, a user may use a hook pole to pull the drag line down to the vessel for connecting the climbing line. This may thereby help to preserve the integrity of the drag line and mitigate the risk of mechanical damage which may otherwise arise if the drag is loose.

In embodiments, the climbing part further comprising a fastener connector for releasably connecting another end of the climbing line to the fastener on the drag line. In this way, a fastener connector may be used to provide a simplified and secure releasable connection to the fastener provided on the drag line.

In embodiments, the climbing part further comprises a secondary climbing line and/or a rescue line, and wherein the locking member is further fixed to one end of the secondary climbing line and/or the rescue line. In this way, additional lines may be connected to the coupling part at the same time for providing additional functionality. For example, the secondary climbing line may be used as a backup in the event of damage to the primary climbing line. Similarly, the rescue line may be used to allow a second user to ascend to provide assistance to a first user on the primary or secondary climbing lines.

In embodiments, the offshore structure is a wind turbine offshore structure, and the coupling part is configured to be mounted to an elevated mounting point above a platform on the wind turbine offshore structure. In this way, the transfer apparatus may be used to allow users, such as maintenance engineers, to access an elevated platform on the wind turbine generator from a vessel, without requiring a powered hoist. Consequently, the apparatus may be used as both a primary or back up system for accessing the wind turbine.

According to a second aspect there is provided a method of transferring a load from a vessel to an offshore structure using the above apparatus in which a coupling part is mounted to an elevated mounting point on the offshore structure, the method comprising the steps of: attaching the climbing line to the fastener provided on the drag line connected to the coupling part; and feeding the drag line through the coupling part to drag the climbing line through the coupling part until the locking member locks against the coupling part for forming a loadbearing connection thereto. In this way, a method for using the above apparatus is provided.

In embodiments, the method further comprises the step of attaching an ascender device to the climbing line and using the ascender device to ascend a load up the climbing line. In this way, the apparatus may be used in conjunction with an ascender/descender device to provide a powered solution for lifting the user, and which the user can carry with them on the vessel to the offshore structure, thereby simplifying maintenance.

In embodiments, the method further comprises the step of attaching an ascender device to the climbing line and using the ascender device to descend a load down the climbing line. In this way, descent from an elevated position may be controlled using the device.

In embodiments, the method further comprises the steps of: attaching the climbing line to the fastener provided on the drag line; feeding the drag line through the coupling part in the opposite direction to drag the climbing line through the coupling part until the locking member unlocks from the coupling part; and detaching the climbing line from the fastener to detach the climbing part. In this way, the climbing part may be detached from the coupling after use. As such, the same climbing part may be re-used to access a plurality of different offshore structures with their own respective drag lines and couplings.

According to a further aspect, there is provided an offshore structure comprising: a platform; a coupling part mounted to an elevated mounting point above the platform; a drag line feedably connected to the coupling part, and comprising a fastener for attaching a climbing line thereto; wherein the climbing line has a locking member fixed to one end, and the drag line and coupling part are configured to allow the climbing line to be dragged through the coupling part until the locking member locks against the coupling part for forming a loadbearing connection thereto. In this way, an offshore structure, such as a wind turbine generator, may be provided with a coupling and drag line pre-installed for facilitating access using a climbing line.

In embodiments, the offshore structure is a monopile offshore structure. Embodiments of the present invention are especially suitable for use with wind turbine monopile offshore structures. For example, the apparatus may be used with smaller vessels and, since access may be implemented from the vessel side, there is no need for the offshore platform to be manned.

Illustrative embodiments of the present invention will now be described with reference to the accompanying drawings, in which.

Figure 1:
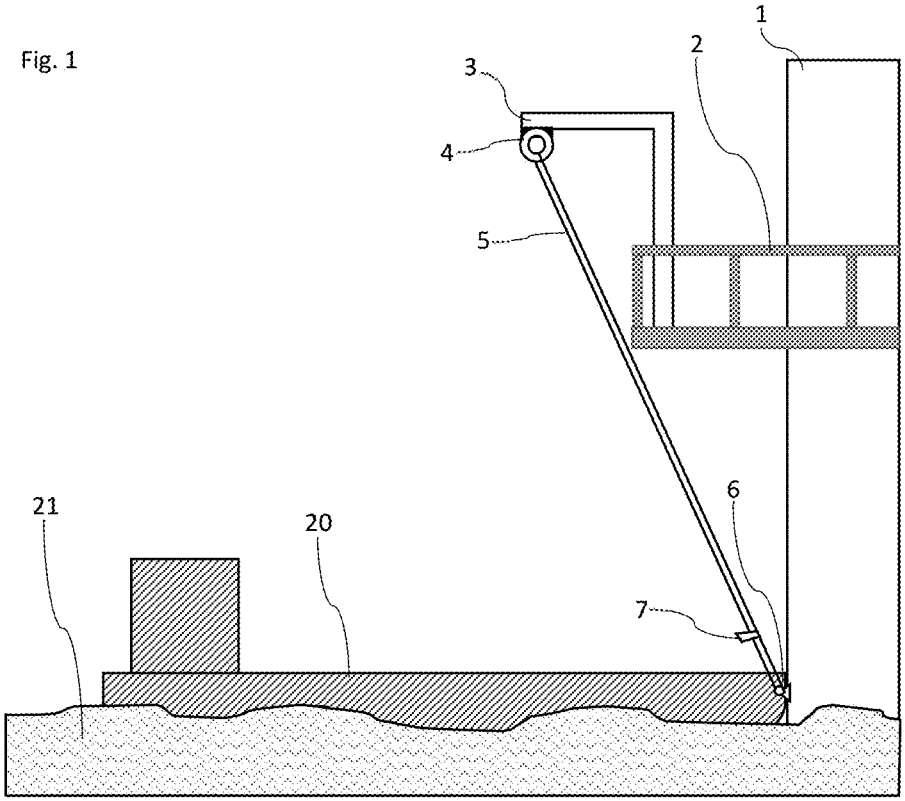
FIG. 1 shows a schematic illustration of a vessel docked against a wind turbine generator incorporating a marine transfer apparatus according to a first illustrative embodiment.

A first illustrative embodiment of the invention will be described with reference to FIGS. 1 to 7. In this embodiment, the marine transfer apparatus is used in conjunction with an offshore wind turbine generator 1 and is used to allow a user to transfer from a vessel 20 to a platform 2 provided on the wind turbine generator 1. In this respect, FIG. 1 shows a vessel 20 docked against the body of the wind turbine generator 1, with the vessel's bow braced against the surface of the wind turbine generator 1 to help to restrain movement of the vessel 20 in the waves 21. As shown, the platform 2 of the wind turbine generator is provided with a climbing attachment structure 3. In embodiments, the climbing attachment structure 3 may form part of a powered hoist used as the primary mechanism for lifting loads, including personnel. As such, the climbing attachment structure 3 is used for a secondary purpose as part of the present arrangement to provide an elevated position for mounting a coupling part 4.

Figure 8:
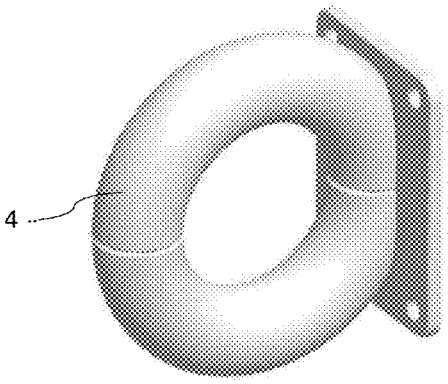
FIG. 8 shows a perspective view of a second example of a coupling part.

In this connection, the coupling part 4 is provided as a ring-shaped body having a central aperture and an upper mounting plate which is bolted onto the climbing attachment structure 3. The main body of the coupling part 4, as is described in further detail in reference to FIG. 6, has a torus or another suitable shape, which forms an inflexible supporting structure around the aperture. An alternative coupling part 4 is illustrated in FIG. 8. As with the first example, this second example has a central aperture and a ring-shaped body. The ring-shaped body is integrated into the coupling part's mounting plate. The mounting plate has a lateral plane perpendicular to the lateral plane of the ring-shaped body and allows the coupling part 4 to be bolted or otherwise fixed onto the climbing attachment structure 3. Accordingly, in this example, the ring-shaped body of the coupling part 4 has the appearance of having a removed segment, with the body and mounting plate being merged. This provides a more compact and sturdy arrangement. It will be understood that the coupling part may be formed by casting. For example, the body of the coupling part 4 may be formed as two semi-circle parts that are welded together and are then bolted and/or welded to the mounting plate.

In this first illustrative embodiment, the drag line 5 is provided as a loop of rope which extends through the coupling part's aperture. The drag line 5 is attached close to sea level of the offshore structure by a lower mounting point 6, which is provided as a second pulley. In embodiments, this may be a simple bearing shaft, which the drag line runs freely over, which may be mounted using magnets to the body of the foundation supporting the wind turbine. In other embodiments, such as the second embodiment described below, the drag line 5 may be provided as a line with two ends, such that it may be fed completely through the coupling part 4 and disconnected from it once a climbing line has been hoisted up.

The drag line 5 is further provided with a carabiner 7 which is attached at a fixed point on the rope of the drag line 5 and provides a reversible connector. It will be understood that the drag line 5 may be pulled around by a user to feed it through the coupling part 4 and the lower mounting point 6. As such, the carabiner 7 can be raised up to the coupling part 4, dragged through its aperture, and then lowered back toward the vessel 20.

Figure 2:
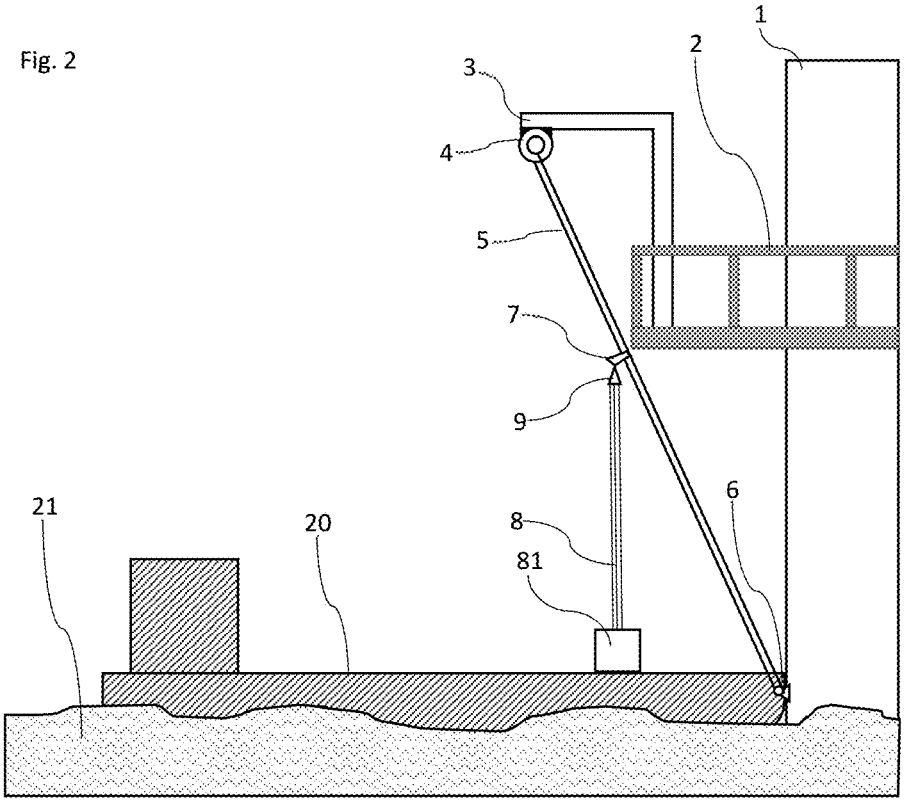
FIG. 2 shows a schematic illustration of the embodiment shown in FIG. 1 once the climbing part has been connected to the drag line.
Figure 7:
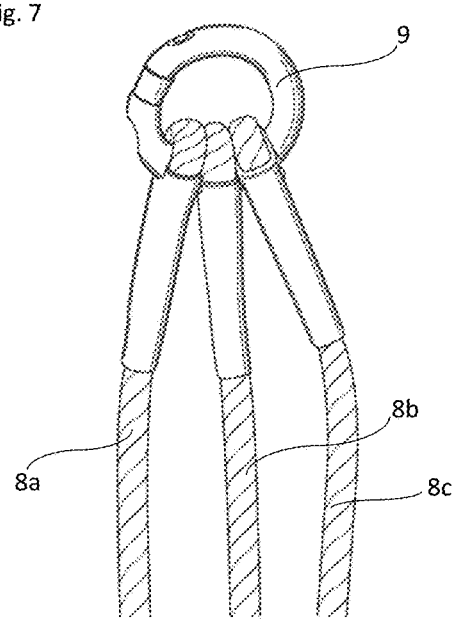
FIG. 7 shows the fastener connector end of the climbing part.

As shown in FIG. 2, a climbing part 8 is used in combination with the drag line 5 and coupling part 4. In this embodiment, the climbing part 8 comprises three rope lines; a primary climbing line 8*a*, a back-up secondary climbing line 8*b* and a rescue line 8*c*. A first end of climbing part 8 terminates in a fastener connector 9, as shown in FIG. 7. As such, the three rope lines 8*a-c* are attached to the ring-like body of the fastener connector 9, which allows the first end of the climbing part 8 to be connected to the carabiner 7. As shown in FIG. 2, this thereby allows the first end of the climbing part 8 to be attached to the carabiner 7 and lifted as the drag line 5 is fed around its mounting.

Figure 3:
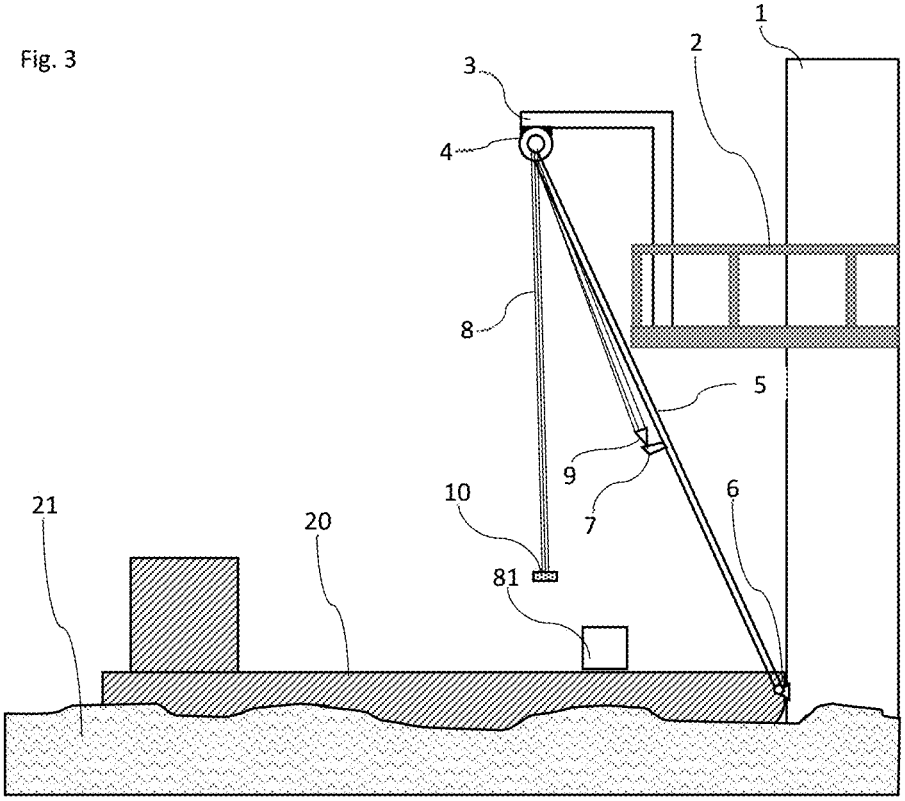
FIG. 3 shows a schematic illustration of the embodiment shown in FIG. 1 once the climbing part has been dragged through the coupling part by the drag line.

As shown in FIG. 3, the second end of the climbing part 8 terminates in a locking member 10. The locking member 10 is shown in further detail in FIGS. 5 and 6, and is provided as a disk-shaped plug into which the three rope lines 8*a-c* are attached. The locking member 10 is sized such that it does not fit through the aperture of the coupling part 4. Consequently, once the climbing part 8 is fed through the coupling part 4 to its second end, the locking member 10 braces against the support ring of the coupling part 4 and plugs the aperture formed therein. This thereby forms a one-way fit, loadbearing connection for each of the three rope lines 8*a-c* to the coupling part 4. In other embodiments, the locking member 10 and coupling part 4 may also engage magnetically, by Velcro fastening, friction or any other relevant means to form a pseudo-permanent bond. This may allow, for example, the wear and tear of the drag line 5 to be minimised when not loaded and following the ship's movements in the sea.

In use, the vessel 20 may be driven into the wind turbine generator 1 to brace its bow. The vessel 20 will carry the climbing part 8, and a user may then attach the fastener connector 9 to the carabiner 7. As shown in FIG. 2, the drag line may then be pulled by the user to lift the first end of the climbing part 8 toward the elevated position. In the illustration, the climbing part 8 is held in a bag 81 and feeds out from there as the fastener connector 9 is hoisted upward.

When the fastener connector 9 reaches the coupling part 4, it is dragged through the aperture by the connection carabiner 7, which draws through the three rope lines 8*a-c*. As shown in FIG. 3, the fastener connector 9 begins descending back toward the vessel 20, drawing the three rope lines 8*a-c* further through the coupling part 4. This process is continued until the locking member 10 reaches the coupling part 4, to form the locking connection shown in FIG. 6. At this stage, the fastener connector 9 can be detached from the carabiner 7, allowing the three rope lines 8*a-c* to hang freely from the coupling part.

Figure 4:
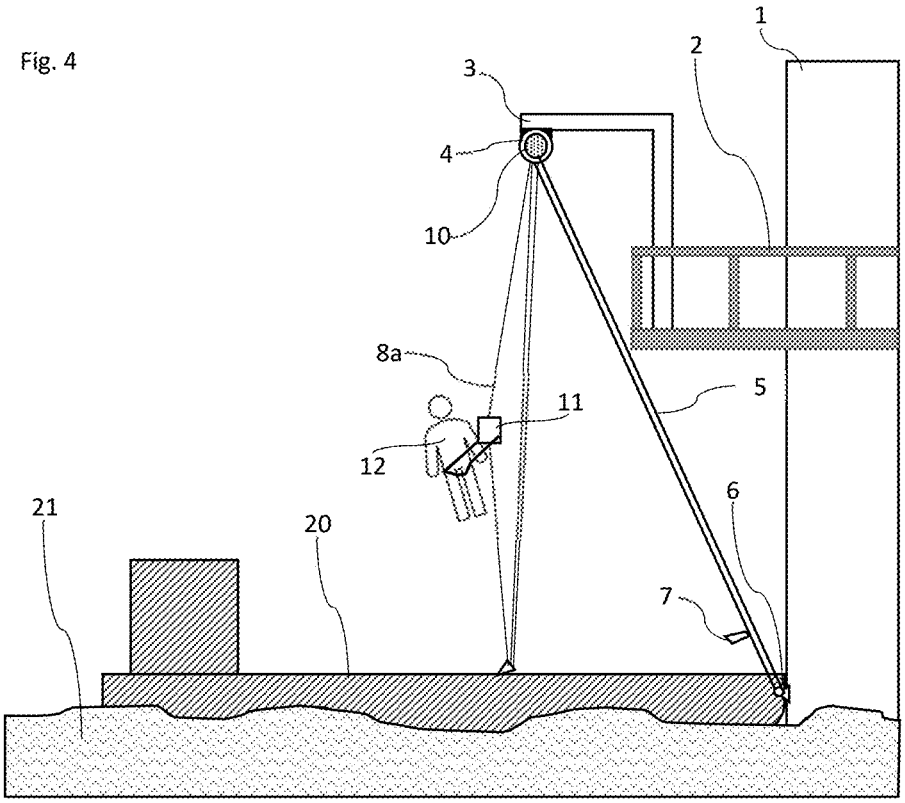
FIG. 4 shows a schematic illustration of the embodiment shown in FIG. 1 once the locking member is locked into the coupling and the climbing part is used by a user to ascend.
Figure 5:
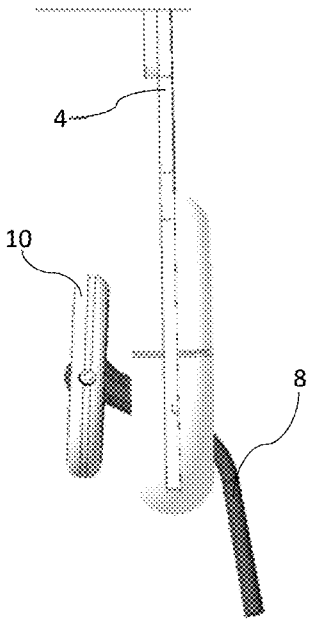
FIG. 5 shows a side view of the coupling part as the locking member nears its locking position.
Figure 6:
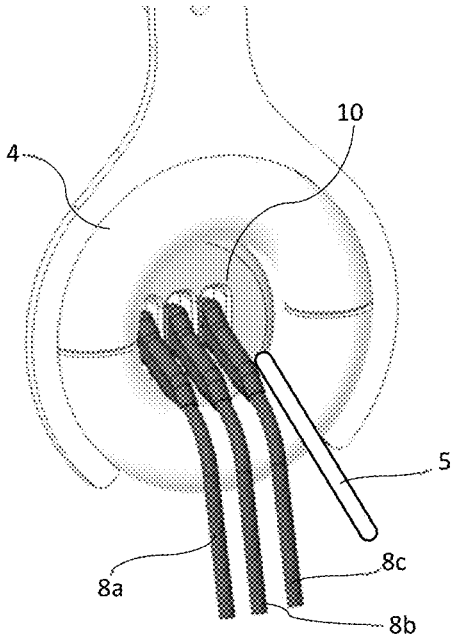
FIG. 6 shows a perspective view of the coupling part with the locking member locked into its locking position.

As shown in FIG. 4, a user 12 may attach an ascender/descender device 11 to the primary climbing line 8*a* and use the rope to ascend to the elevated position allowing them to access the platform 2. The user 12 may simultaneously connect to the primary climbing line 8*b* as a backup connection. The rescue line 8*c* could be used to reach the user 12 in the event of an emergency.

Once the user 12 has ascended and/or descended, the climbing part 8 may be detached from the coupling 4 by connecting the fastener connector 9 to the carabiner 7 and then feeding the drag line 5 in the opposite direction. The slack provided on the climbing part 8, together with the action of the drag line 5 acts to dislodge the locking member 10 from the coupling part 4, allowing it to then be lowered as the drag line moves the carabiner 7 back toward the coupling. This process is continued until the carabiner 7 has carried the fastener connector 9 back to the vessel, where it can be detached to allow the climbing part 8 to be removed and used at a different site.

Figure 9:
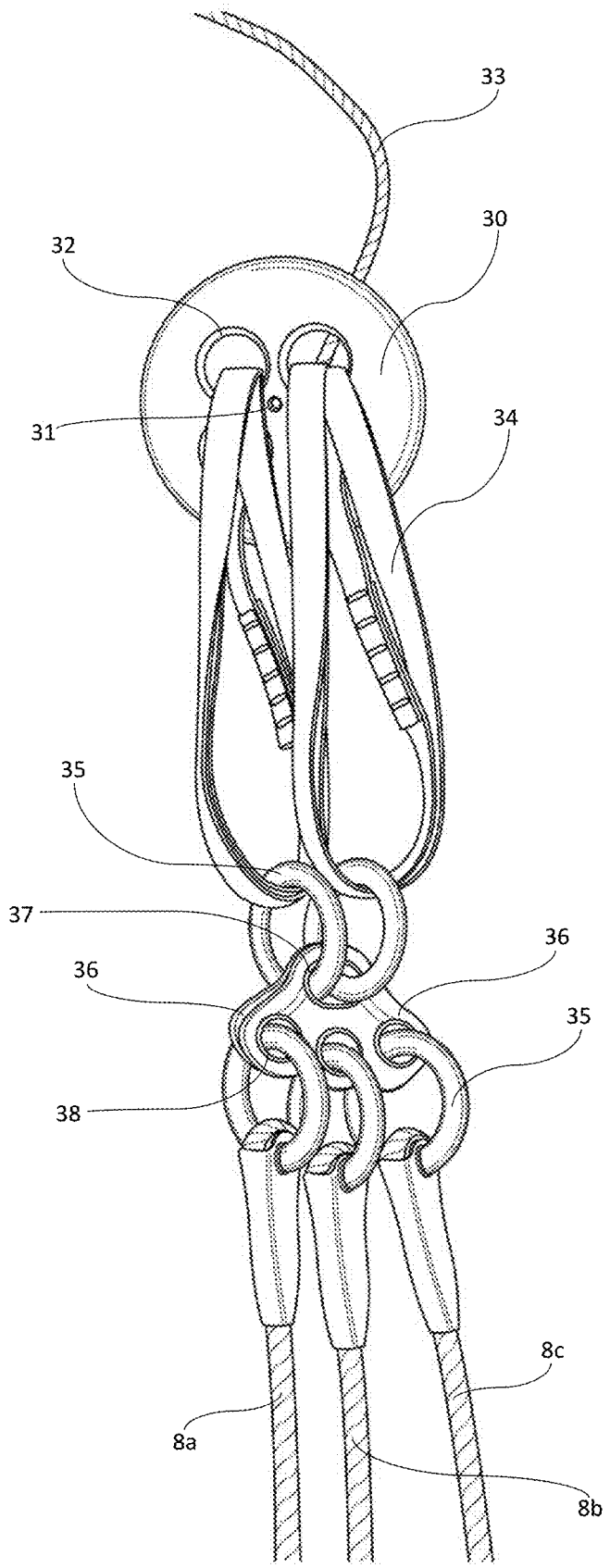
FIG. 9 shows a locking member end of the climbing part according to a second illustrative embodiment.
Figure 10:
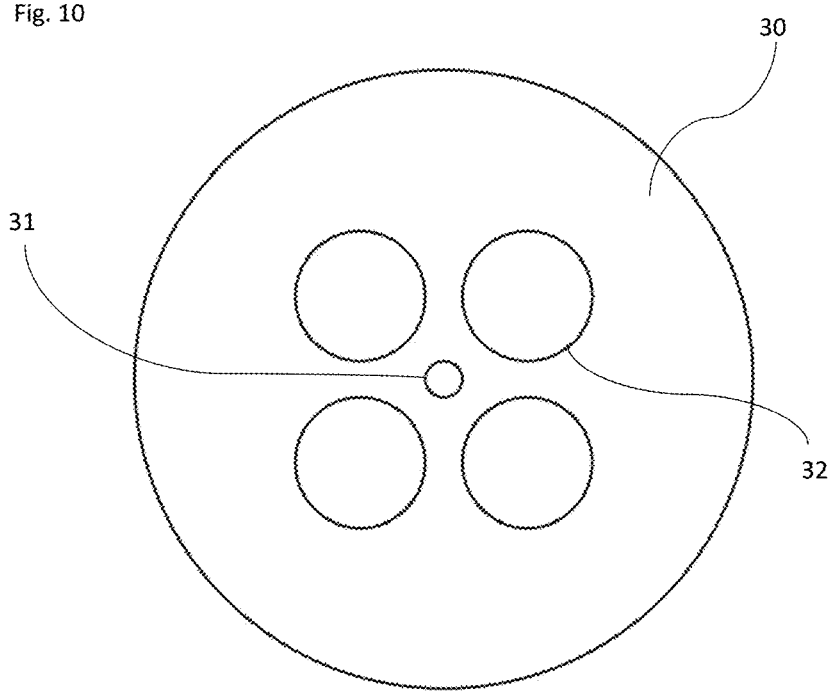
FIG. 10 shows the locking member according to the second illustrative embodiment.

FIGS. 9 and 10 show a locking member end of a climbing part according to a second illustrative embodiment. In this embodiment, the drag line 5 is provided as a line with two ends, such that it may be fed completely through the coupling part 4 and disconnected from it once a climbing line has been hoisted up. That said, the device otherwise operates in substantially the same way as the first embodiment. In this embodiment, the locking member 30 has, within the boundary of its circular anchor plate, a central aperture 31 surrounded by four outer apertures 32, as shown in FIG. 10. The four outer apertures 32 are spaced equidistant from each other around the central aperture 31.

As shown in FIG. 9, a pull-down cord 33 is securely fastened to the central aperture 31. The pull-down cord 33 enables the locking member 30 to be disengaged from the coupling part 4 once operations are finished and the climbing part is no longer needed. To disengage the locking member 30 from the coupling part 4, a user can pull on the pull-down cord 33 which releases the locking member 30 from the coupling part 4. As mentioned above, in this second illustrative embodiment, the drag line 5 is provided as a length of rope, with one end coupled close to sea level on the offshore structure at a lower mounting point 6, and a carabiner 7 is attached to the other end. The drag line 5 is installed so that it passes through the coupling part's aperture, such that the drag line 5 may be drawn through the aperture by a user lift the climbing part 8.

As shown in FIG. 9, in this embodiment, the locking member end includes two anchor slings 34, provided as closed loops of webbing. Each anchor sling is passed through two of the outer apertures 32, such that each anchor sling 34 forms two anchor sling loops from the sling ends extending from the respective two outer apertures 32. The anchor sling loops are coupled together by respective connector rings 35. As such, a separate connector ring 35 is used for each anchor sling 34. The edges of the outer apertures 32 of the locking member 30 can be filleted, or rounded, to reduce friction between the outer aperture 32 and the anchor slings 34, and to increase the strength of the locking member 30 by distributing the load more evenly.

Two rigging plates 36 are coupled to the connectors 35 from the anchor slings 34, with the two plates shown next to one another in the drawing. The provision of at least two rigging plates 36 provides for redundancy, such that if one of the rigging plates 36 were to fracture during operation, the other rigging plate 36 still provides back-up load baring capacity. The rigging plate 36 has a main aperture 37, through which the ring connectors 35 of the anchor slings 34 are coupled, and three lower apertures 38. A connector ring 35 is coupled to each of the lower aperture 38, and each of these connectors 35 is coupled to one of three rope lines 8*a-c*.

In operation, the carabiner 7 may be initially releasably secured to the lower mounting point 6 when not in use, with the drag line 5 being looped up through the coupling part 4. When used, a user detaches the carabiner 7 and connects the fastener connector 9 of the climbing part 8. The drag line 5 may then be used to drag the carabiner 7, and hence the climbing part 8, up through the coupling part 4 until the carabiner 7 is lowered back toward the vessel 20. As with the first embodiment, the three rope lines 8*a-c* are drawn through the coupling part 4 until the locking member 30 reaches the coupling part 4, to form a locking connection. One or more of the rope lines 8*a-c* can then be used as climbing lines for ascending or descending the structure. In reverse, the pull-down cord 33 enables the carabiner 7 of the drag line 5 to be passed back through the coupling part 4 when the user pulls the pull-down cord 33. In so doing, the carabiner 7 of the drag line 5 is returned to its original position, such that it can be used again.

It will be understood that although in the above illustrative second embodiment redundancy is built into the arrangement with duplicate connections between coupling parts, other embodiments may have simpler coupling arrangements. For example, rather than two anchor slings 34 and two rigging plates 36, as shown in FIG. 9, other embodiments may have a single anchor sling and/or a single rigging plate forming the connections. Such parts may, for instance, be additionally reinforced to mitigate any safety risks of having reduced redundancy.

Figure 11:
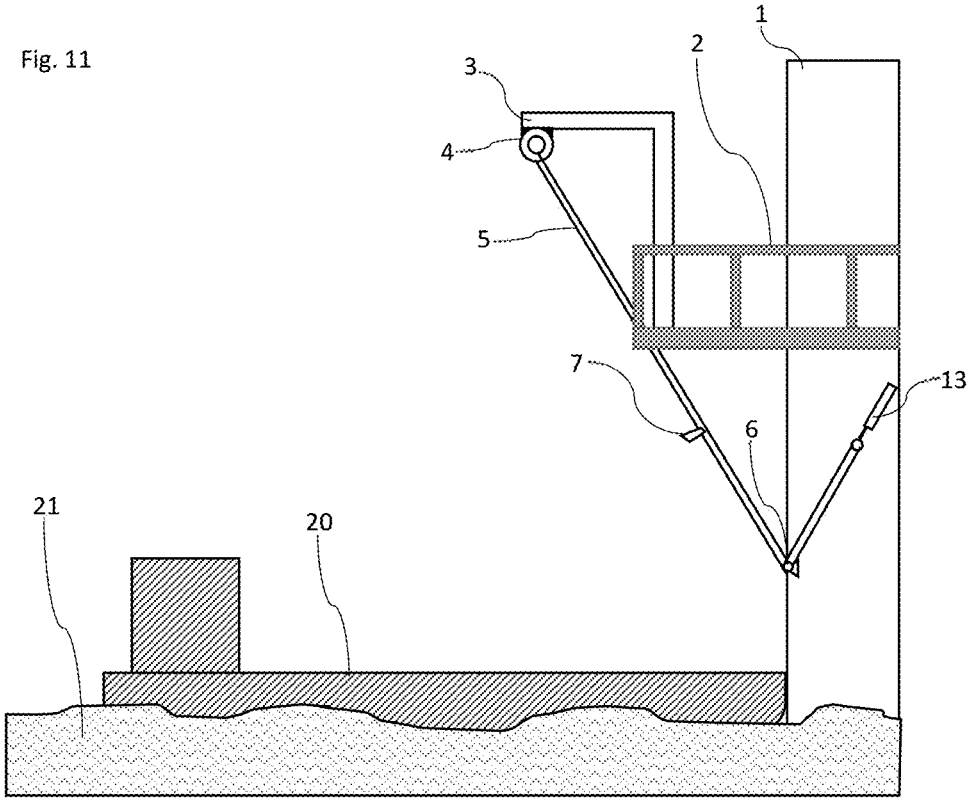
FIG. 11 shows a schematic illustration of a vessel docked against a wind turbine generator incorporating a marine transfer apparatus according to a third illustrative embodiment.

FIG. 11 shows a third illustrative embodiment. This embodiment is substantially the same as the first embodiment, but further includes a tensioner mechanism 13 for tensioning the drag line 5 into a retracted position. As shown, the tensioner mechanism 13 includes a pulley which draws the drag line upward. As such, the drag line 5 can be mounted in a more elevated position on the foundation, above the waterline and away from the waves 21 and vessel engagement location. This is especially relevant in areas with a high tide. To access the drag line 5, a user may hook the line with a hook pole from the vessel 20 and draw the drag line 5 out against the resilience of the tensioner 13. The user can then connect the fastener connector 9 to the carabiner 7 to connect the climbing part 8 to the coupling, as with the first embodiment. As such, this may thereby help to preserve the integrity of the drag line 5 and mitigate the risk of mechanical damage which may otherwise arise if the drag line 5 is loose.

It will be understood with the above arrangements, a wind turbine engineer or other user can use the drag line 5 to feed the locking member 10 through the coupling part 5 to form a locking engagement therebetween. Once in place, the user can use the primary climbing line 8*a* to ascend up to the platform 2. As the apparatus may be operated manually, the risk of mechanical breakdown is avoided. At the same time, only the drag line 5 needs to remain on-site at the wind turbine generator 1 and, even then, this line does not have a load bearing function during ascent. As such, the drag line's extended exposure to environmental conditions does not present a hazard. Similarly, the integrity of the climbing line can be preserved, and the line may be inspected prior to use to maintain safety. Therefore, the climbing line can be used to provide safe access to an offshore structure from a vessel, without needing to rely on a powered hoist or ladder.

It will be understood that the embodiments illustrated above show examples only for the purposes of illustration. In practice, embodiments may be applied to many different configurations, the detailed embodiments being straightforward for those skilled in the art to implement.

For example, whilst reference has been made to various 'lines', it will be understood that these may be provided as ropes, cables, or chains, for example. Equally, whilst the illustrative embodiments have been disclosed with three lines, it will also be understood that different numbers may be provided.

The invention claimed is:

1. Marine transfer apparatus for transferring a load between a vessel and an offshore structure, the apparatus comprising:

a coupling part for mounting to an elevated mounting point on the offshore structure;

a climbing part comprising a climbing line and a locking member fixed to one end of the climbing line, the climbing line being feedable through the coupling part until the locking member locks against the coupling part for forming a loadbearing connection thereto for transferring the load; and a drag line feedably connected to the coupling part, and comprising a fastener for attaching the climbing line for dragging it through the coupling part as the drag line is fed therethrough for forming the loadbearing connection.

2. Marine transfer apparatus according to claim 1, wherein the coupling part comprises a support defining an aperture through which the drag line is secured, and wherein the locking member is configured to lock against the coupling part by engaging with the support to form the loadbearing connection thereto.

3. Marine transfer apparatus according to claim 2, wherein the support defines a ring, and wherein the locking member comprises a disc-shaped plug configured to lock against the ring.

4. Marine transfer apparatus according to claim 2, wherein the coupling part forms an upper pulley.

5. Marine transfer apparatus according to claim 1, wherein the drag line comprises a loop connected through the coupling part.

6. Marine transfer apparatus according to claim 1, further comprising a lower pulley for connecting the drag line to a lower mounting point on the offshore structure.

7. Marine transfer apparatus according to claim 6, further comprising a tensioner mechanism for tensioning the drag line into a retracted position, and wherein the tensioner mechanism can be operated for allowing the drag line to be drawn out to an extended position.

8. Marine transfer apparatus according to claim 1, wherein the climbing part further comprises a fastener connector for releasably connecting another end of the climbing line to the fastener on the drag line.

9. Marine transfer apparatus according to claim 1, wherein the climbing part further comprises a secondary climbing line and/or a rescue line, and wherein the locking member is further fixed to one end of the secondary climbing line and/or the rescue line.

10. Marine transfer apparatus according to claim 1, wherein the offshore structure is a wind turbine offshore structure, and the coupling part is configured to be mounted to an elevated mounting point above a platform on the wind turbine offshore structure.

11. A method of transferring a load from a vessel to an offshore structure using the apparatus of any preceding claim in which a coupling part is mounted to an elevated mounting point on the offshore structure, the method comprising the steps of:

attaching the climbing line to the fastener provided on the drag line connected to the coupling part; and feeding the drag line through the coupling part to drag the climbing line through the coupling part until the locking member locks against the coupling part for forming a loadbearing connection thereto for transferring the load.

12. A method according to claim 11, further comprising the step of attaching an ascender device to the climbing line and using the ascender device to ascend a load up the climbing line.

13. A method according to claim 11, further comprising the step of attaching an ascender device to the climbing line and using the ascender device to descend a load down the climbing line.

14. A method according to claim 11, further comprising the steps of:

attaching the climbing line to the fastener provided on the drag line;

feeding the drag line through the coupling part in the opposite direction to drag the climbing line through the coupling part until the locking member unlocks from the coupling part; and detaching the climbing line from the fastener to detach the climbing part.

15. An offshore structure comprising:

a platform;

a coupling part mounted to an elevated mounting point above the platform;

a drag line feedably connected to the coupling part, and comprising a fastener for attaching a climbing line thereto;

wherein the climbing line has a locking member fixed to one end, and the drag line and coupling part are configured to allow the climbing line to be dragged through the coupling part until the locking member locks against the coupling part for forming a loadbearing connection thereto for transferring a load.

* * * * *